US006134988A

United States Patent [19]

Huang

[11] Patent Number: 6,134,988

[45] Date of Patent: Oct. 24, 2000

[54] ACTUATING DEVICE FOR AN ELECTRICAL POWER WRENCH

[75] Inventor: Wan-Chang Huang, Tai San Hsiang, Taiwan

[73] Assignee: Yon Jin Industrial Co. Ltd., Taipei Hsien, Taiwan

[21] Appl. No.: 09/398,397

[22] Filed: Sep. 17, 1999

[51] Int. Cl.[7] ..... B25B 13/00

[52] U.S. Cl. ..... 81/54; 173/93.5

[58] Field of Search ..... 81/54, 429, 480, 81/57.42; 173/93, 93.5, 178

[56] References Cited

U.S. PATENT DOCUMENTS

| | | | |
|---|---|---|---|
| 5,412,546 | 5/1995 | Huang | 362/119 |
| 5,839,518 | 11/1998 | Setsuko | 173/176 |
| 5,915,484 | 6/1999 | Hsieh | 173/176 |
| 5,941,319 | 8/1999 | Juan | 173/93.5 |
| 5,954,141 | 9/1999 | Li et al. | 173/93.5 |

*Primary Examiner*—David A. Scherbel
*Assistant Examiner*—Hadi Shakeri

[57] ABSTRACT

An actuating device for an electrical power wrench includes a base member connected to a motor and an output shaft is rotatably connected to the base member. A pin biased by a spring movably extends through the base member. Two blocks extend from a side of the base member and located in opposite to the output shaft. A movable frame with a weight movably retained between the two blocks and two springs connected between the two ends of the movable frame and the two blocks. An L-shaped actuating member is rotatably connected between the two blocks and connected to two lugs of the movable frame so that when the base member is rotated by the motor, the movable frame radially moves due to the eccentric force so as to pivot the actuating member. The pivotal movement of the actuating member pushes the pin to extend from the other side of the base member to impact a plate extending radially outward from the output shaft. The output shaft outputs sudden and large torque.

10 Claims, 6 Drawing Sheets

ACTUATING DEVICE FOR AN ELECTRICAL POWER WRENCH

FIELD OF THE INVENTION

The present invention relates to an actuating device for an electrical power wrench and includes a pin which radially impacts a plate mounted to the output shaft by a pivotal movement of a pushing member which is actuated by a movable frame when an eccentric force is applied to the frame.

BACKGROUND OF THE INVENTION

Conventional actuating devices for an electrical power wrenches known to applicant are respectively disclosed in U.S. Pat. No. 4,920,831 assigned to Dora Hsiao Ling Huang with the title of "VEHICLE-CARRYING PURPOSE WRENCH", U.S. Pat. No. 5,740,892 to Chen Shu-Hsia Huang with the title of "POWER WRENCH TORQUE TRANSMISSION MECHANISM" and U.S. Pat. No. 5,035,161 to Dora H. Huang with the title of "WRENCH". All of the cited U.S. Patents concern a transmission device to produce an intermittent torque so as to loosen/tighten a bolt or a nut. Nevertheless, the wrenches cited in the mentioned patents involve a complicated structure and too many parts that takes time to assemble and maintain.

The present invention intends to provide an actuating device for an electrical power wrench wherein the output shaft has a plate mounted thereto which is radially impacted by a pin controlled by the eccentric force of the power wrench. The pin extends and radially impacts the plate when the desired eccentric force of the base member driven by a motor is reached. The present invention has arisen to mitigate and/or obviate the disadvantages of the conventional power wrenches.

SUMMARY OF THE INVENTION

In accordance with one aspect of the present invention, there is provided an actuating device for an electrical power wrench and comprising a base member having a tubular member extending from centrally a first side thereof so as to be connected to a motor, and a passage defined through the base member for receiving a pin therein which is biased by a spring. Two blocks extend from the first side of the base member. A movable frame is movably connected to the first side of the base member with a weight connected to a first end of the movable frame. Two lugs extend from the movable frame and which is retained by a guide plate connected to the first side of the base member. Two springs are respectively connected between the rods and the movable frame.

An actuating member has a first part engaged with the two lugs of the movable frame, and a second part of the actuating member extends from the first part at an angle relative to the first part. The actuating member is pivotally connected between the two blocks and the second part of the actuating member located adjacent the pin. An output shaft is rotatably and centrally connected to the second side of the base member, and a plate extends radially outward from the output shaft.

The primary object of the present invention is to provide an actuating device which impacts the plate on the output shaft when the motor rotates so as to output a sudden and large torque on the object.

Another object of the present invention is to provide an actuating device wherein the movement of the pin to impact the plate of the output shaft is resulted in the eccentric force caused from the rotation of the base member driven by the motor.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
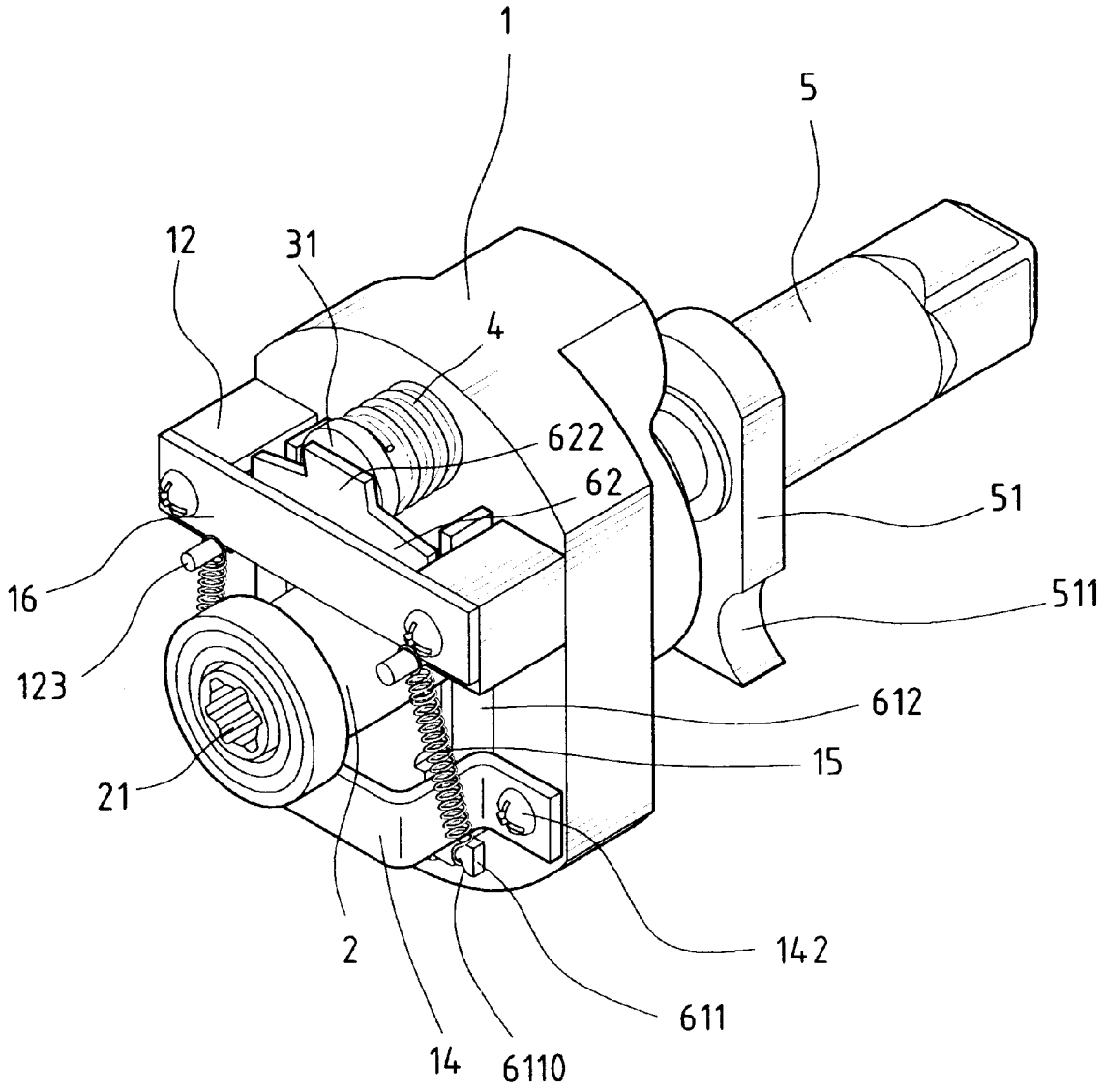
FIG. 1 is a perspective view of the actuating device in accordance with the present invention.
Figure 2:
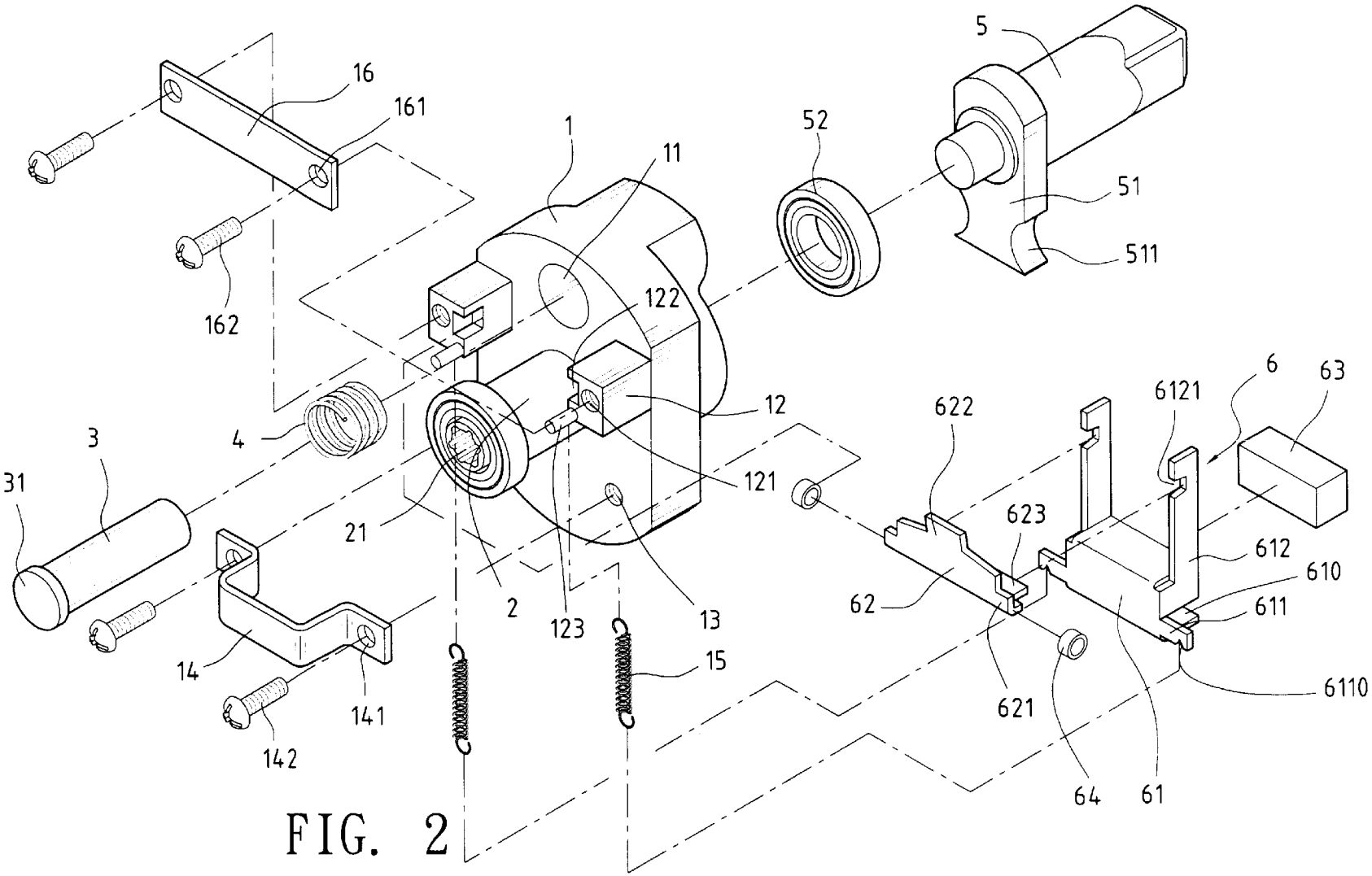
FIG. 2 is an exploded view of the actuating device in accordance with the present invention.
Figure 3:
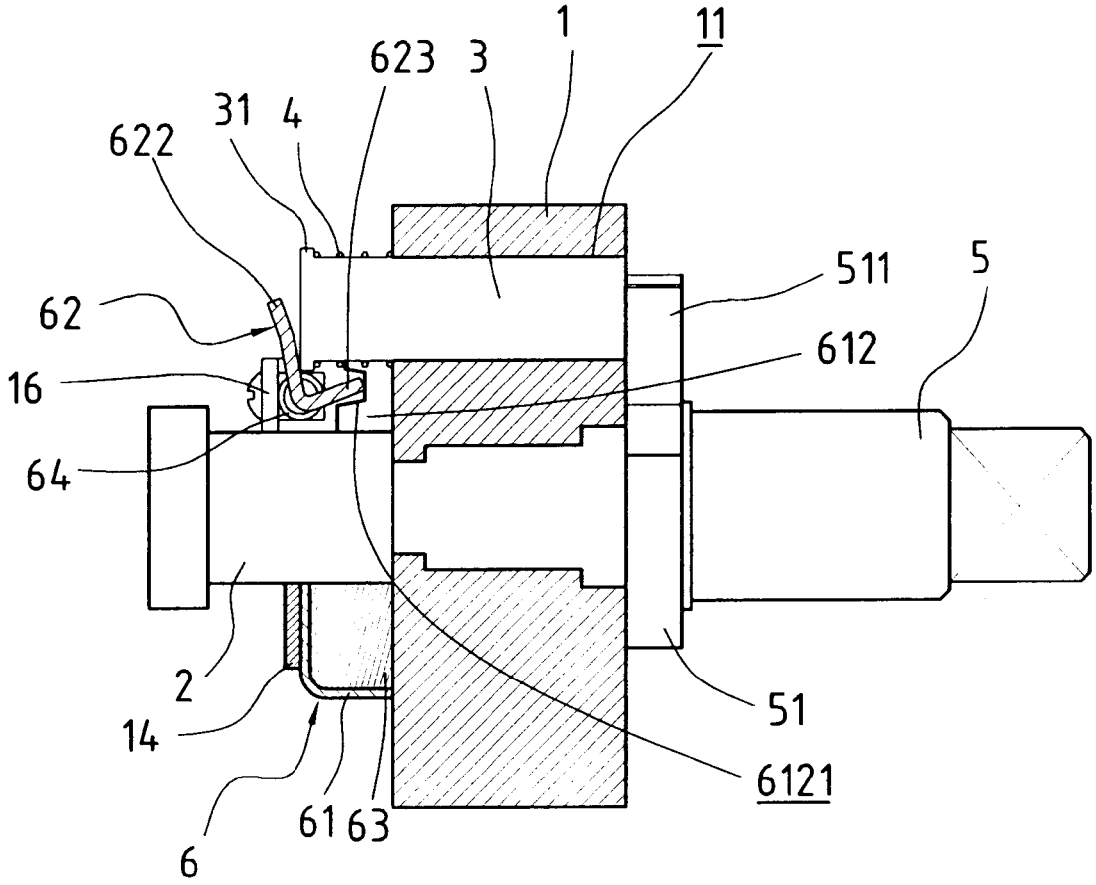
FIG. 3 is a side elevational view, partly in section, of the actuating device in accordance with the present invention, wherein the pin is received in the passage and the base member is not yet rotated.

Referring to FIGS. 1 to 3, the actuating device for an electrical power wrench in accordance with the present invention comprises a base member 1 having a tubular member 2 extending from centrally a first side of the base member 1 and the tubular member 2 has a polygonal hole 21 for receiving a driving shaft of a motor (not shown). A passage 11 is defined through the base member 1 and located above the tubular member 2, two blocks 12 extending from the first side of the base member 1. The two blocks 12 each have a notch 122 defined in the inside thereof, and a rod 123 extends from and a threaded hole 121 is defined in the distal end of each block 12.

A movable frame 6 has a U-shaped chamber 610 defined in a side of a first end thereof so as to receive a weight 63 therein. Two lugs 612 extend from the movable frame 6 and each lug 612 has an engaging recess 6121 defined in a side thereof. Two side plates 611 respectively extend from two ends of the actuating member 62 and each side plate 611 further has a dent 6110 so that the movable frame 61 is movably connected to the first side of the base member 1 by two springs 15. One end of the spring 15 is engaged with the dent 6110 and the other end of the spring 15 is engaged with the rod 123.

An actuating member 62 has a first part 623 engaged with the engaging recesses 6121 in the two lugs 612 of the movable frame 61, and a second part 622 of the actuating member 62 extends from the first part 623 at an angle relative to the first part 623. The actuating member 62 has two protrusions 621 extending from two ends thereof and each protrusion 621 has a bearing 64 mounted thereto which is received in the notches 122 of the two blocks 12 so that the actuating member 62 is rotatably engaged between the two blocks 12. The retaining plate 16 is connected to the two blocks 12 by two bolts 162 extending through two holes 161 in two ends of the retaining plate 16 and engaged with the threaded holes 121 in the two blocks 12 so as to prevent the actuating member 62 from disengaging from the two notches 122 of the two blocks 12.

A pin 3 is movably inserted in the passage 11 and has a head 31 on one of two ends thereof. A spring 4 is mounted to the pin 3 and biased between the first side of the base member 1 and the head 31 of the pin 3. The spring 4 maintains the pin 3 not to extend from the second side of the base member 1 when the motor is not operated.

A U-shaped guide plate 14 is connected to the first side of the base member 1 by extending bolts 142 through two holes 141 in the two ends of the guide plate 14 and engaged with two threaded holes 13 in the first side of the base member 1. The two sides of the U-shaped guide plate 4 guides the two lugs 612 to be moved along the two sides of the guide plate 14.

An output shaft 5 is rotatably and centrally connected to the second side of the base member 1 by mounting a bearing 52 to the output shaft 5. The output shaft 5 has a rectangular engaging end so as to be connected to a socket (not shown). A plate 51 extends radially outward from the output shaft 5 and has two semi-circular recesses 511 defined in two opposite sides thereof.

Figure 4:
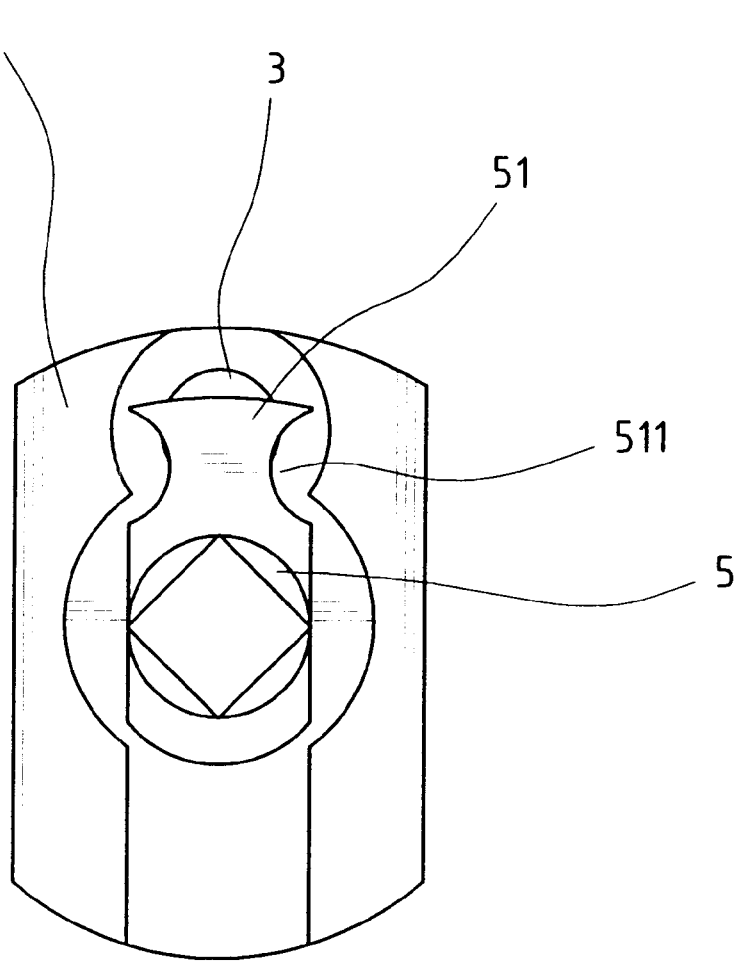
FIG. 4 is an illustrative view to show the position relationship between the plate on the output shaft and the pin when the base member is not yet rotated.
Figure 5:
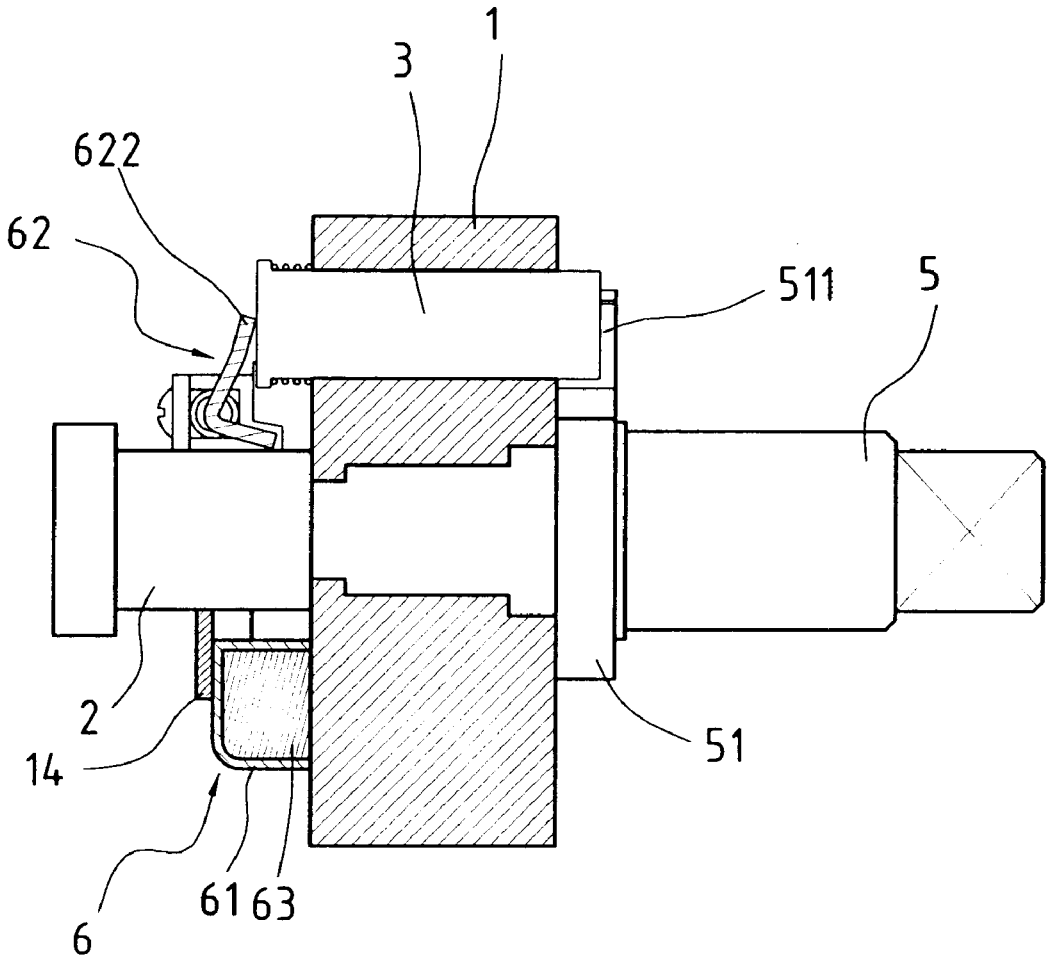
FIG. 5 is a side elevational view, partly in section, of the actuating device in accordance with the present invention, wherein the pin extends from the second end of the base member when the base member is rotated by the motor.
Figure 6:
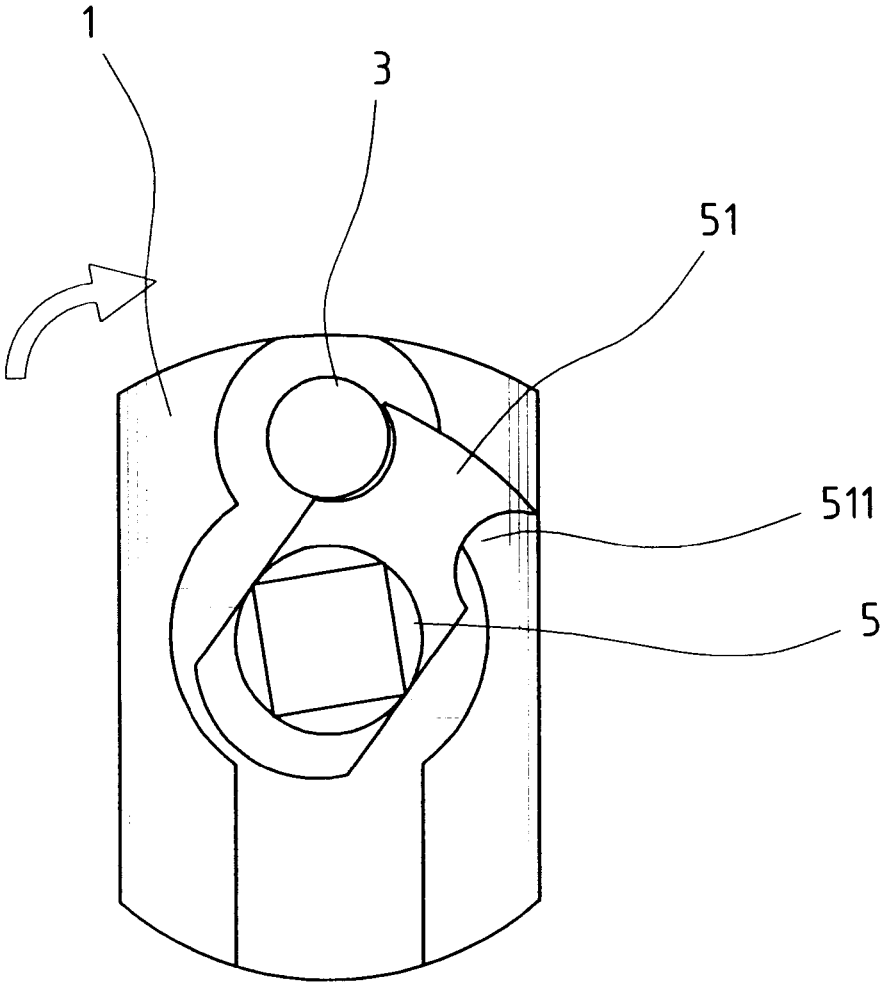
FIG. 6 is an illustrative view to show the rotational pin impacts the plate on the output shaft to let the output shaft rotate.

Referring to FIG. 4, the pin 3 is received in the passage 11 in the base member 1 when the motor does not rotate, the plate 51does not contact the pin 3. Referring to FIGS. 5 and 6, when the motor rotates, the base member 1 together with the movable frame 61 are rotated, the eccentric force will let the movable frame 61 move radially relative to the tubular member 2. When the movable frame 61 moves due to the eccentric force, the first part 623 engaged with the two lugs 612 of the movable frame 61 is pulled and the second part 622 is pivoted about the protrusions 621 so as to push the pin 3 extend from the second side of the base member 1 to impact the plate 51 at the position of the recess 511. Therefore, the output shaft 5 outputs a sudden and large torque. The rotation of the base member 1 produce intermittent torque to the object such as bolt or nut so that the bolt or nut is loosened easily.

The structure is simple and the torque is generated due to the eccentric force applied to the weight 63 in the movable frame 61 so that no complicated transmission mechanism required.

While we have shown and described various embodiments in accordance with the present invention, it should be clear to those skilled in the art that further embodiments may be made without departing from the scope and spirit of the present invention.

What is claimed is:

1. An actuating device for an electrical power wrench, comprising:

a base member having a tubular member extending from centrally a first side of said base member and said tubular member adapted to be connected to a motor, a passage defined through said base member and two blocks extending from said first side of said base member;

a movable frame movably connected to said first side of said base member, a weight connected to a first end of said movable frame and two lugs extending from said movable frame, two springs respectively connected between said blocks and said movable frame, a guide plate connected to said first side of said base member and guiding said two lugs;

an actuating member having a first part engaged with said two lugs of said movable frame, and a second part of said actuating member extending from said first part at an angle relative to said first part, said actuating member pivotally connected between said two blocks;

a pin movably inserted in said passage and biased by a spring mounted to said pin;

an output shaft rotatably and centrally connected to said second side of said base member, a plate extending radially outward from said output shaft, said movable frame moving radially relative to said tubular member due to a rotation of said base member, and said actuating member pivoted and said pin pushed by said second part to extend from said second side of said base member to impact said plate.

2. The device as claimed in claim 1, wherein said plate has two recesses defined in two opposite sides thereof so that said pin engages with one of said recesses when said pin extends from said second side of said base member.

3. The device as claimed in claim 1, wherein said two blocks each have a notch and said actuating member has two protrusions extending from two ends thereof so as to be rotatably engaged with said two notches.

4. The device as claimed in claim 3 further comprising a retaining plate connected to said two blocks so as to prevent said actuating member from disengaging from said two notches of said two blocks.

5. The device as claimed in claim 3, wherein said movable frame has two side plates extending form two ends thereof and each side plate of said movable frame has a bearing mounted thereto which is received in said notch in said block.

6. The device as claimed in claim 1, wherein said guide plate is a U-shaped member with two sides, said two lugs of said movable frame located between said two sides of said U-shaped guide plate.

7. The device as claimed in claim 1, wherein said two lugs each have an engaging recess defined in a side thereof and said first part of said actuating member is engaged with said two engaging recesses.

8. The device as claimed in claim 1, wherein said movable frame has a U-shaped chamber defined therein for receiving said weight therein.

9. The device as claimed in claim 1, wherein said movable frame has two side plates extending from two ends thereof and each side plate has a dent, each block having a rod extending therefrom so that one end of said spring is engaged with said dent and the other end of said spring is engaged with said rod.

10. The device as claimed in claim 1, wherein said pin has a head so that said spring is biased between said first side of said base member and said head.

* * * * *